US005596167A

United States Patent [19]

Davis

[11] Patent Number: 5,596,167

[45] Date of Patent: Jan. 21, 1997

[54] SHOT CARTRIDGE FOR A MUZZLE LOADING FIREARM AND PROCESS FOR LOADING A MUZZLE LOADING FIREARM

[76] Inventor: Richard V. Davis, 120 Jay St. #4, Lakewood, Colo. 80226

[21] Appl. No.: 538,245

[22] Filed: Oct. 3, 1995

[51] Int. Cl.[6] ..... F42B 7/00

[52] U.S. Cl. ..... 102/532; 102/449; 102/522; 42/90

[58] Field of Search ..... 102/430, 438, 102/448, 449, 450, 451, 452, 453, 456, 462, 463, 506, 520–523, 532; 42/51, 90

[56] References Cited

U.S. PATENT DOCUMENTS

| | | | |
|---|---|---|---|
| 33,754 | 11/1861 | Sawyer | 102/506 |
| 157,793 | 12/1874 | Cochran | 102/453 |
| 200,876 | 3/1878 | Sawyer | 102/506 |
| 2,767,656 | 10/1956 | Zeamer | 102/438 |
| 3,180,265 | 4/1965 | Rybak | 102/451 |
| 3,516,360 | 6/1970 | Lathrope et al. | 102/451 |
| 3,568,603 | 3/1971 | Vartanian | 102/453 |
| 3,575,113 | 4/1971 | Ashbrook | 102/451 |
| 4,050,175 | 9/1977 | Mulinix . | |
| 4,152,858 | 5/1979 | Dobbs . | |
| 4,207,698 | 6/1980 | Burson . | |
| 4,291,625 | 9/1981 | Stagg, Jr. | 102/449 |
| 4,373,285 | 2/1983 | Grout et al. . | |
| 4,536,983 | 8/1985 | Fry . | |
| 4,759,885 | 7/1988 | Kurtz | 102/431 |
| 4,974,357 | 12/1990 | Jones et al. . | |
| 5,094,024 | 3/1992 | Duke . | |
| 5,138,950 | 8/1992 | Gardner et al. . | |
| 5,164,539 | 11/1992 | French . | |

FOREIGN PATENT DOCUMENTS

| | | | |
|---|---|---|---|
| 1183276 | 7/1959 | France | 102/448 |
| 593153 | 5/1959 | Italy | 102/463 |
| 576510 | 10/1977 | U.S.S.R. | 102/448 |

OTHER PUBLICATIONS

*The American Rifleman*, "Ingenious Device Speeds Muzzle--Loading" by Glenn E. Emmons, Dec. 1973, p. 45.

*Primary Examiner*—Harold J. Tudor

*Attorney, Agent, or Firm*—John R. Wahl; Holland & Hart

[57] ABSTRACT

A multiple projectile cartridge for a muzzle loading firearm which comprises a plurality of projectiles, a plastic cup sized to fit into a bore of the muzzle loading firearm containing the projectiles and a top wad inserted into and retained in the open end of the cup by a retaining means in the tubular portion of the cup. The tubular portion of the cup includes several spaced longitudinal slots extending from the open end toward the base of the cup defining petals therebetween. The retaining means preferably includes a radial peripheral groove adjacent the open end of each of the petals of the tubular portion of the cup. The periphery of the top wad engages this groove to retain the top wad in place and in turn retain the shot load in the shot cup when the cartridge is inserted into the bore of the muzzle loading firearm.

21 Claims, 2 Drawing Sheets

SHOT CARTRIDGE FOR A MUZZLE LOADING FIREARM AND PROCESS FOR LOADING A MUZZLE LOADING FIREARM

This application is related to Disclosure Document No. 360162, filed Aug. 22, 1994.

BACKGROUND OF THE INVENTION

Field of the Invention

The present invention is generally related to ammunition and more particularly related to a container for supporting a plurality of projectiles such as shot during handling, loading, and subsequent firing of a muzzle loading firearm and the process for loading the firearm using this container.

Description of the Related Art

Muzzle loading firearms such as rifles and pistols have rifled barrels designed for firing single projectiles known as balls or miniballs which require a spin to achieve stable projectile flight. They are not designed for firing a load of shot such as is the case with smooth bore shotguns. Consequently, a hunter who, for example, wishes to shoot doves or clay pigeons as well as deer with a muzzle loading firearm needs to have at least two black powder weapons, e.g. , a rifle and a shotgun.

Muzzle loading firearms, such as rifles, are typically loaded in a three step process which basically involves pouring a charge of black powder down the rifle bore, placing a lubricant patch over the muzzle and then placing a lead ball on the patch, and then ramming the patched ball down the bore with a ramrod to seat the ball against the powder charge. Shotguns, on the other hand, require an extra step in the loading procedure to be followed if the shot is to stay in the gun barrel. First an appropriate charge of black powder is measured and poured into the shotgun barrel. Then a wad is inserted to separate the powder from the charge of shot pellets which is loaded into the barrel next. Finally, a top wad of paper, felt or other material is packed on top of the shot to retain the shot load in place. This top wad must be of proper size or it will either adversely affect the shot pattern or, if too small, permit the shot to roll out the barrel when the shotgun is tilted downward or jolted sufficiently to dislodge the top wad, as might occur during hunting.

There have been a number of cartridges and load container assemblies proposed for speeding up the loading of muzzle loading firearms and improving the consistency between loads. U.S. Pat. Nos. 4,050,175; 4,152,858; 4,207,698; 4,373,285; 4,536,983; 4,974,357; and 5,094,024 provide examples of such cartridges and loaders. These patents are directed to the accurate loading of ball and charge in an expeditious and efficient manner. However, the cartridges and loaders described therein are primarily designed for loading single projectiles in rifles or pistols. They do not utilize a carrier for the projectile.

A recent design for a projectile carrier or sabot for a projectile used in a muzzle loading firearm is disclosed in U.S. Pat. No. 5,164,539. This patent discloses a plastic cup shaped carrier formed from two halves which are held together by a fibrous base wad ring. The two halves form a cylindrical cup to receive the rear portion of a generally cylindrical projectile such as a conventional copper jacketed semi-wadcutter bullet. The carrier has an outer body diameter which closely matches the land-to-land diameter of the gun bore. Each of the two halves has a flange around its outer perimeter at the base having a diameter approximately equal to the groove-to-groove diameter which engages the lands and grooves of the rifling in the gun bore. Upon muzzle exit, the two halves are designed to separate and fall away, permitting the projectile to continue down range. One potential disadvantage of this design is that there appears to be nothing to hold the projectile axially in place in the sabot since it is only the perimeter flange that engages the rifling in the bore and not the cup body. Consequently, under a shock load the projectile may be dislodged from the carrier such as would occur if the muzzle of the rifle were dropped or bumped against the ground or other hard surface. Also, there is nothing in the cup to hold the projectile rotationally in place in the carrier during spinup. Consequently the spin on the projectile may be compromised resulting in less accuracy.

Turning now to shotguns, one approach to simplifying the loading process for a muzzle loading shotgun was described in the December 1973 issue of The American Rifleman. In this article, the author suggests forming a shot loader from a Polaroid photograph swab container, a plastic 12-gauge shotgun shell, a conventional 12-gauge shot cup wad, a top wad, and a charge of black powder. The assembled loader has a cylindrical body made out of the shotshell (with the basewad and head removed). A conventional shot container cup/wad containing a shot load is pushed into one end of the shotshell and a top wad placed in the other end. The Polaroid swab container, containing a powder charge, is then slip fit into the other end of the shotshell so that the open end of the swab container presses against the top wad over the shot load. The top wad holds the shot in place and separates the powder from the shot. The open end of the Polaroid container holds the top wad in place in the shotshell. The swab container and the shotshell are then taped together with electrical tape.

The user then loads the shotgun by first removing the cap on the Polaroid swab container and pouring the powder charge into the shotgun barrel. The other end of the loader is then placed over the muzzle so that the base of the shot container cup/wad fits into the bore of the shotgun barrel. The shot container wad, the load of shot, and the top wad are then rammed home against the powder charge via use of a ram rod.

There are several disadvantages with this design. First, the shot load is more voluminous than the volume of the shot cup/wad. Therefore some of the shot can scrape against the barrel during loading and firing of the shotgun. If steel shot is used, as is required today in most locations, this would result in unacceptable wear to the barrel. Second, the over shot or top wad must be correctly sized, i.e. sized to tightly fit into the shotgun bore, or the shot could all fall out the muzzle. Third, the shot is not be positively contained. Finally, this design cannot be used to contain shot loads in rifles and pistols since conventional shotshell cup/wads and casings are not properly sized for most rifle and pistol calibers.

SUMMARY OF THE INVENTION

The present invention specifically overcomes the disadvantages in the prior art discussed above. It is thus an object of the present invention to provide a muzzle loading multiple projectile or shot cartridge which facilitates retention of shot in place in the cartridge during handling and loading.

It is another object of the invention to provide a shot cartridge for use in a muzzle loading rifle or pistol having a rifled barrel.

It is another object of the invention to provide a muzzle loading shot cartridge that can be used with non-toxic shot such as steel.

It is a further object of the invention to provide a preassembled shot cartridge which can be quickly and efficiently loaded into a black powder firearm without danger of shot loss during the loading or handling of the firearm.

It is a still further object of the invention to provide a shot cartridge that allows the use of a rifle or pistol as a shotgun.

The present invention is a multiple projectile cartridge for a muzzle loading firearm which comprises a plurality of projectiles, a plastic cup containing the projectiles, a disk shaped top wad, and retention means on the cup for retaining the top wad in place over the projectiles thereby retaining the projectiles in the cup. The cup is sized with an outer diameter approximately equal to or slightly less than the land-to-land diameter of the bore of the firearm so that it will have a snug, frictional slip fit into the bore.

The cup is generally cylindrical and has a generally cylindrical base portion and a tubular portion extending from the base portion to an open end. The tubular portion of the plastic cup has a plurality of spaced slots extending longitudinally from the open end toward the base portion of the cup defining petals therebetween. Each of the petals includes an internal peripheral retaining means proximate the open end for engaging and retaining a disc shaped top wad in place over the load of projectiles such as shot carried in the cup.

The tubular portion of the cup preferably has four equally spaced longitudinal slots forming four equally sized petals. Preferably the retaining means includes a circumferential, inwardly opening groove nearly adjacent the open end of each petal. The groove is sized to complementarily receive a peripheral rim portion of the top wad. The top wad is gripped symmetrically in these petal grooves and effectively prevents the shot from becoming dislodged from the cup during transport of the assembled cartridge or when the loaded firearm is bumped or jostled as would occur during a hunt. The petals of the cartridge protect the bore of the firearm from deleterious contact with the projectiles as they are accelerated toward the muzzle upon firing the weapon. Upon muzzle exit, the petals spread out due primarily to air resistance, releasing the top wad and the shot load, which continues down range to the intended target.

During assembly and handling of the cartridge, the petals are prevented from deflecting radially outward, which would release the top wad, by a separate, removable outer sleeve around the cartridge. This sleeve has an outer diameter greater than the bore diameter so that the sleeve is retained against the muzzle of the firearm as the cartridge of the invention is pushed into the bore of the firearm. The sleeve has an inner diameter approximately equal to the bore diameter. The retaining function of this outer sleeve is replaced by the bore of the firearm when the cartridge is loaded into the firearm.

Further objects, features, and advantages of the invention will become more apparent from the detailed description of the invention which follows when taken in conjunction with the accompanying drawing.

BRIEF DESCRIPTION OF THE DRAWING

The accompanying drawing which is incorporated in and forms a part of the specification illustrates complete preferred embodiments of the present invention according to the best modes presently devised for the practical application of the principles of the invention.

DETAILED DESCRIPTION OF THE INVENTION

Figure 1:
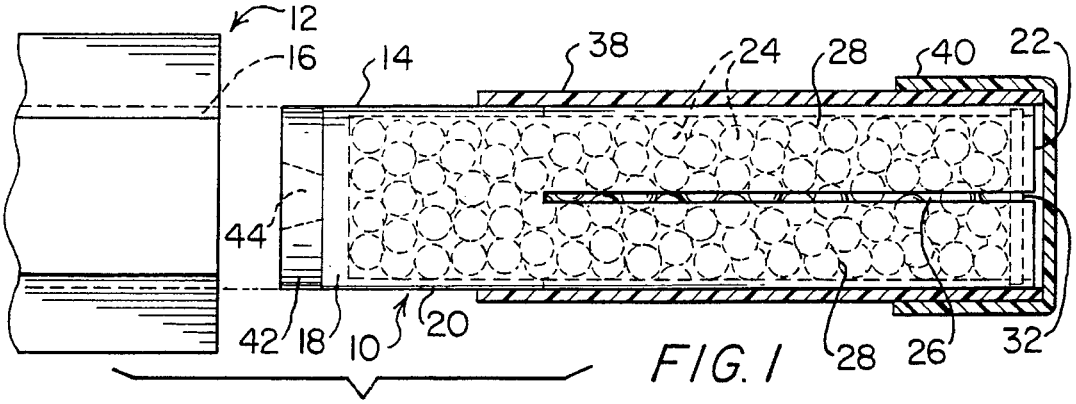
FIG. 1 is a side view of one embodiment of an assembled multiple projectile cartridge for a muzzle loading firearm in accordance with the present invention with portions of the sleeve broken away to reveal the cartridge assembly beneath.

For the purposes of promoting an understanding of the principles of the invention, reference will now be made to the embodiments illustrated in the drawing and specific language will be used to describe the same. It will nevertheless be understood that no limitation of the scope of the invention is thereby intended. The embodiments illustrated and explained are exemplary only. Like reference numerals are used to designate similar structures in the views of the various Figures. Alterations and further modifications of the illustrated cartridge assembly, and such further applications of the principles of the invention as illustrated therein being contemplated as would normally occur to one skilled in the art to which the invention relates are intended to be within the scope of the invention.

A multiple projectile cartridge 10 in accordance with a first embodiment of the invention is shown in a side view in FIG. 1, spaced from the muzzle of a muzzle loading rifle 12. The cartridge 10 comprises a plastic shot cup 14 sized to frictionally slip fit into the bore 16 of the rifle 12. The cup 14 is preferably injection molded of a flexible plastic such as high density polyethylene. It is to be understood that other materials may be used, however, polyethylene is presently preferred. The cup 14 is generally cylindrical and has a generally cylindrical base portion 18 and a tubular portion 20 extending from the base portion 18 to an open end 22. The tubular portion 20 carries a plurality of projectiles therein such as shot pellets 24. The shot pellets 24 may be of any conventional size and grade presently available, e.g., from 00 Buckshot to No. 8 bird shot. Shot pellets 24 may be made of lead but preferably are steel shot or other nontoxic shot, especially where waterfowl may be the intended target.

The tubular portion 20 of the plastic shot cup 14 has a plurality of parallel, spaced slots 26 therein extending longitudinally from the open end 22 toward the base portion 18. In this first embodiment there are four spaced slots 26 equally radially spaced around the tubular portion 20 defining petals 28 therebetween, and, in this case, defining four petals 28. Each of the slots 26 is preferably no more than about ⅛ inch wide. The slots 26 may extend fully to the base portion 18 or may extend only part way as is shown in FIG. 1. It is to be understood that a fewer or greater number of slots may alternatively be provided, such as three or five. However, they should be radially equally spaced so that the petals formed have approximately the same mass, shape and size.

Figure 2:
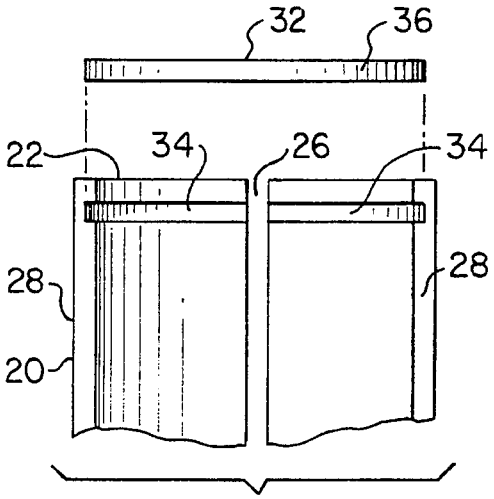
FIG. 2 is an exploded, partial sectional view of the open end of a first embodiment of the tubular portion of the shot cup and top wad in accordance with the present invention.

Each of the petals 28 includes a peripheral retaining means proximate the open end 22 for holding a disc shaped top wad 32 in the open end of the cup 14 over the load of shot pellets 24. This retaining means, in the first embodiment, is preferably an inwardly open, peripheral, i.e. circumferential, groove 34 proximate the open end 22 of each petal 28 of the tubular portion 20. An enlarged, partial view through the slots 26 of the open end 22 of the tubular portion 20 of the cup 14 is shown in FIG. 2 showing two petals 28. The groove 34 has a flat bottom cross section and straight side walls that are preferably perpendicular to the bottom. The disc shaped top wad 32 has a peripheral rim 36 that is generally complementary in shape to that of the groove 34 in each of the petals 28. The peripheral rim 36 may also be configured with a single chamfer or bevel on the corner of the rim 36 facing the shot cup 14 to facilitate engagement with the grooves 34. The top wad 32 may be made of paper, cardboard or a plastic such as polyethylene. The principal requirement is that the top wad be light in weight and relatively rigid. The grooves 34 are preferably located approximately adjacent the open end, i.e., spaced from the open end 22 a shod distance as is shown in FIG. 1 so as to provide sufficient plastic material at the open end 22 to provide support for retaining the top wad 32 in the grooves 34. This distance may be as little as an eight of an inch or less, depending on the wall thickness of the petals 28 and the material of which the cup 14 is made.

The slots 26 permit the petals 28 to deflect outward when the top wad 32 is installed over a load of shot pellets 24 in the open end 22 of the tubular portion 20 allowing the peripheral rim 36 of the top wad 32 to slip into the grooves 34 to complete the assembly of the cartridge 10. However, during assembly, storage, transport, and loading of the cartridge 10, some means must be provided to hold the petals 28 in place to retain the top wad 32 in the grooves 34. This means is preferably a tubular sleeve 38 which has an inside diameter approximately equal to that of the rifle bore 16. As is shown in FIG. 1, this sleeve 38 extends over the open end 22 and over the tubular portion 20. The sleeve 38 may be made of any suitable material since it does not enter the rifle bore 16 and therefore does not contribute any parasitic mass to the fired load. The sleeve 38 is preferably also made of high density polyethylene or other suitable plastic material, however. The sleeve 38 has an outside diameter greater than the bore 16 of the rifle 12 so that it can rest against the muzzle of the rifle 12. When the cartridge 10 is pushed out of the sleeve 38 and into the bore 16 of the rifle 12, the side wall of the bore 16 prevents the petals 28 from deflecting outward and thus continues to securely holds the top wad 32 in the grooves 34.

The sleeve 38 has two open ends with one end being closed with a removable cap 40. This cap 40 is preferably made of a flexible, resilient plastic or rubber material so that it can removably fit over and close the one end of the sleeve 38 covering the open end 22 of the tubular portion 20 of the shot cup 14.

The cartridge 10 preferably has a lubricated, fibrous wad 42 fastened to the rear face of the base portion 18 of the cup 14 as is shown in FIG. 1. This fibrous wad 42 lubricates and scrapes any residual black powder in front of it in the rifle bore 16 as the cartridge 10 is pushed down the bore 16 until the cartridge 10 seats against the powder charge. The wad 42 also provides a gas seal between the bore 16 and the shot cup 14 during ignition of the powder charge and acceleration of the cartridge 10 down the bore 16. The wad 42 is preferably secured to the base portion 18 by mounting the same on a central flared post 44. The central flared post 44 is an integral part of the base portion 18. The post may be of any suitable cross-sectional shape such as square, cylindrical or flared as is illustrated in FIG. 1. Flared is preferred, however, because this shape assists in retaining the wad 42 securely in place against the rear face of the base portion 18 of the shot cup 14.

Figure 6:
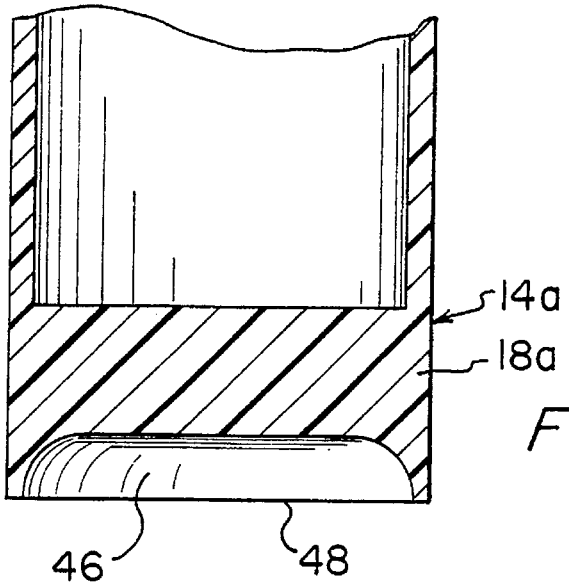
FIG. 6 is a sectional view of an alternative base portion of the shot cup in accordance with the present invention.

The lubricated fibrous wad 42 may be omitted as is shown in the cross sectional view of an alternative base portion **18*a* of the shot cup 14*a* in FIG. 6 if the base portion 18*a* of the shot cup 14*a* includes a concave recess 46 in the rear face. The recess 46 in the base portion 18*a* in this alternative cup 14*a* causes the ignition pressures to spread the rear peripheral portion 48 of the of the base portion 18*a* outward to effect a gas seal against the rifle bore 16** in a manner as is well known in the art.

Figure 3:
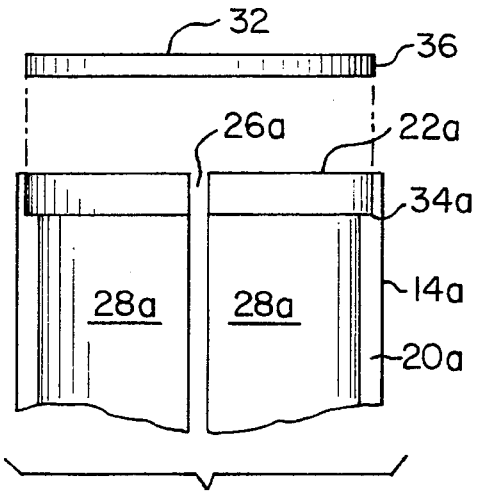
FIG. 3 is an exploded, partial sectional view of the open end of a second embodiment of the tubular portion of the shot cup and top wad in accordance with the present invention.

A first alternative embodiment of the retaining means for holding the top wad in place is shown in FIG. 3. The open end **22*a* of the tubular portion 20*a* has an "L" shaped circumferential inner ledge 34*a* adjacent the open end 22*a* instead of a groove as in FIGS. 1 and 2. The top wad 32*a* fits into the open end 22*a* and rests against the ledge 34*a* of each of the petals 28*a*. If the fit of the cartridge 10 is tight in the bore 16, then this arrangement may be satisfactory. The top wad 32*a* may also be adhesively secured against the ledge 34*a*** to ensure cartridge integrity.

Figure 4:
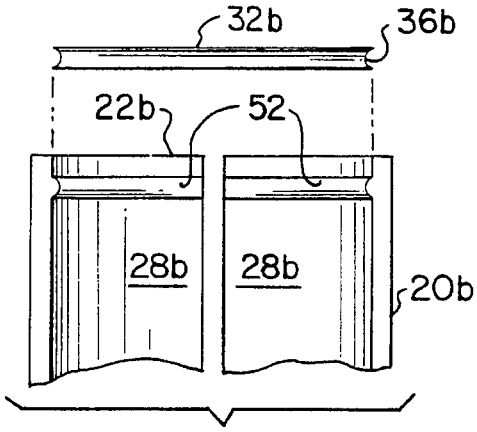
FIG. 4 is an exploded, partial sectional view of the open end of a third embodiment of the shot cup and top wad in accordance with the invention.

A second alternative embodiment of the retaining means is shown in FIG. 4. In this alternative embodiment, the retaining means comprises a top wad **32*b* having a peripheral grooved rim 36*b* which engages a corresponding inwardly projecting radial peripheral, i.e. circumferential, rib 52 adjacent the open end 22*b* of each of the petals 28*b* of the tubular portion 20*b*** of the shot cup.

Figure 5:
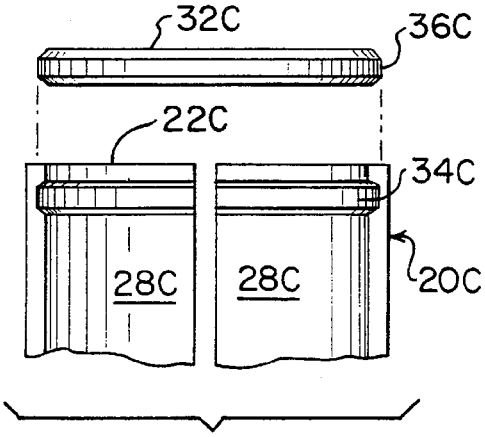
FIG. 5 is an exploded, partial sectional view of the open end of a fourth embodiment of the shot cup and top wad in accordance with the invention.

A third alternative embodiment of the retaining means is shown in FIG. 5. This embodiment is similar to the first embodiment except that the peripheral rim **36*c* of the top wad 32*c* is beveled to form a shape complementary to the diverging side walls of the groove 34*c* in each of the petals 28*c* proximate the open end 22*c*** of the shot cup. In a similar manner, other arrangements of the retaining means may also be utilized and are envisioned as being within the scope of the invention. Those illustrated and described herein are merely exemplary of the various configurations which may be used.

Figure 7:
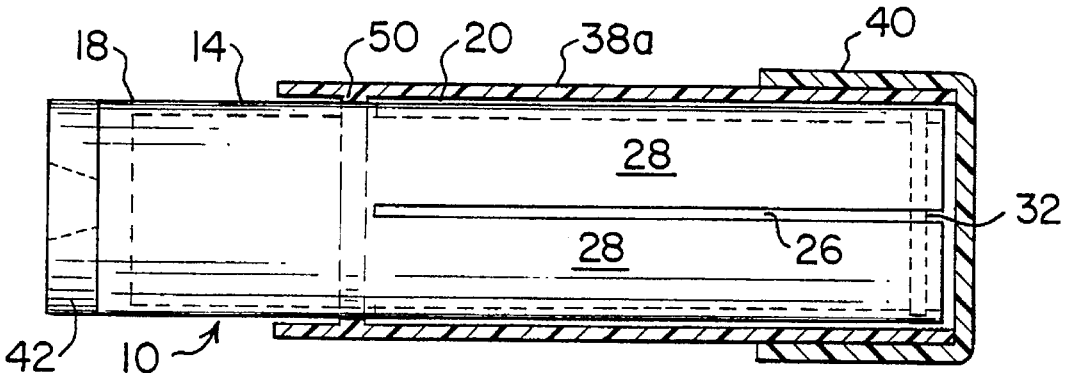
FIG. 7 is a side view of a shot cartridge as in FIG. 1 with a first alternative sleeve configuration in accordance with the invention.

Turning now to FIG. 7, the sleeve **38*a* may optionally have an internal radial rib or ridge 50 projecting inwardly near the open end opposite the cap 40 to frictionally grip the tubular portion 20 of the cartridge 10 when the sleeve 38*a* is fully installed on the shot cup 14. This rib 50 may also engage a corresponding peripheral detent channel or groove in the outer surface of the shot cup 14 to help hold the sleeve 38 in place on the shot cup 14** during handling, storage and transport.

Figure 8:
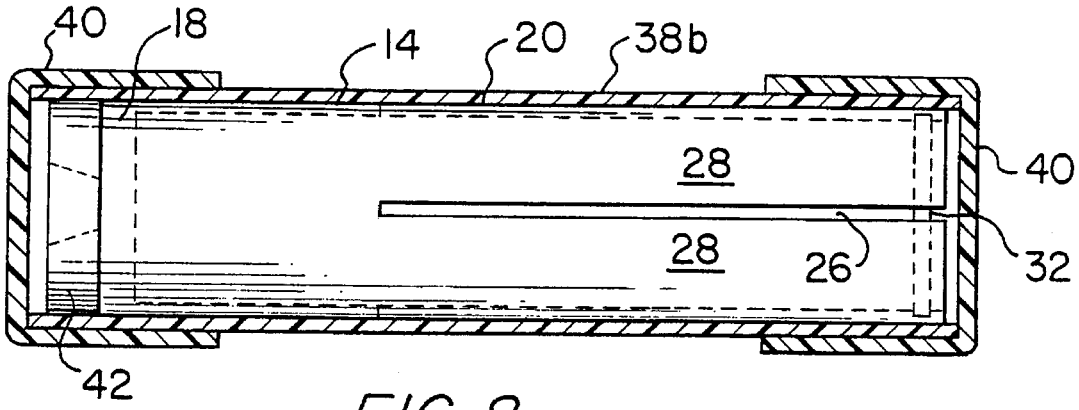
FIG. 8 is a side view of a shot cartridge as in FIG. 1 with a second alternative sleeve configuration in accordance with the present invention.

In a second alternative sleeve design shown in FIG. 8, the cartridge 10 may have a sleeve **38*b* thereover which has an opposite end extending fully over the base portion 18 and the wad 42. This opposite open end of the sleeve 38***b* is preferably fitted with a second cap 40 to complete the assembly.

Loading of the cartridge 10 in accordance with the invention involves the following steps. The user holds an empty shot cup 14 upright and pours a load of shot pellets 26 into the tubular portion 20 preferably while holding the petals 28 parallel to each other to prevent the shot from falling out through the slots 26. Holding the petals 28 may be necessary since the petals 28 of the tubular portion 20 are preferably thin and flexible. Alternatively, the user can slide the sleeve 38 over the base portion 18 and partially over the tubular portion 20, leaving the open end 22 exposed, to hold the petals 28 in place during shot loading. Next the top wad 32 is installed into the open end 22 and snapped into the grooves 34. The sleeve 38 is then slid over the open end 22 of the shot cup 14 and the cap 40 is installed on the open end of the sleeve 38 over the top wad 32. Finally, a fibrous lubricated wad 42 may be installed, if required, on the rear face of the base portion 18. If the alternative, long sleeve 38*a* is used during the cartridge assembly, then the sleeve 38*a* is slid over the base portion 18 and the fibrous wad 42 and a second cap 40 is installed over the opposite end of the sleeve 38*a*.

Loading of the multiple projectile cartridge 10 into a muzzle loading firearm in accordance with the present invention comprises the following steps:

1. loading a powder charge into the bore of the muzzle loading firearm;
2. removing the cap 40 from the end of the sleeve 38 over the open end 22 of the cartridge 10;
3. positioning the sleeve 38 against the muzzle of the firearm with the base portion 18 of the multiple projectile cartridge 10 in or in alignment with the bore 16;
4. holding the sleeve 38 against the muzzle; and
5. pushing against the top wad 32 with the tip of a conventional ramrod to push the cartridge 10 through the sleeve 38 and down the bore 16 of the firearm 12 until the cartridge 10 is seated against the powder charge.

In the first embodiment of the invention shown in FIG. 1 and the alternative embodiment shown in FIG. 7, the step of positioning may also include inserting the base portion 18 of the shot cup 14 into the bore 16 in order to position the sleeve 38 against the muzzle of the firearm or rifle 12.

In loading the alternative sleeve embodiment shown in FIG. 8, an additional step is required. The removing step also includes removing the second cap 40 from the opposite end of the sleeve 38 prior to placing the sleeve 38 against the muzzle of the firearm.

If the user desires to load a smaller shot load than the internal volume of the shot cup 14 would otherwise require, a spacer wad may be placed under or over the shot prior to inserting the top wad 32. This spacer wad should be as light as possible to avoid significant shot pattern disruption if placed on top of the shot load. A spacer wad of tissue paper may be used, for example.

The cartridge 10 in accordance with the present invention protects the rifling in the bore of the firearm against scoring which could otherwise occur during firing. In addition, the use of the cartridge in accordance with the invention permits a shooter to use the same firearm as both a shotgun and a rifle (or pistol) and thus expand the usefulness of the firearm against a wider variety of targets. Thus the shooter can use one rifle for both deer and doves, for example.

While the invention has been described above with reference to specific preferred embodiments thereof, it is apparent that many changes, modifications, and variations can be made without departing from the inventive concept disclosed herein. For example, different lengths of tubular portions 20 may be manufactured in each caliber to permit various loading configurations. Alternatively, the petals 28 may additionally include a plurality of longitudinally spaced peripheral grooves 34 which are spaced from the open end 22 at various distances to accommodate the user who wants to vary the shot load size, without having to resort to a spacer wad. In this case the top wad 32 would be placed in the groove 34 closest to the top of the shot load. The base portion 18 of the shot cup 14 may alternatively have a reduced outer diameter to accomodate application of a conventional lubricated patch over and between the base portion 18 and the rifle bore 16 during loading of the cartridge 10 thus eliminating the need for a lubricated base wad 42 as shown in FIG. 1. Accordingly, it is intended to embrace all such changes, modifications, and variations that fall within the spirit and broad scope of the appended claims. All patents, patent applications, and other publications cited herein are hereby incorporated by reference in their entirety.

What is claimed is:

1. A multiple projectile cartridge for a muzzle loading firearm comprising:

a plurality of projectiles;

a plastic cup sized to fit into a bore of a muzzle loading firearm and containing said plurality of projectiles, said cup having a base portion and a cylindrical tubular portion extending from said base portion around said projectiles to an open end, said tubular portion having a plurality of spaced slots extending from said open end toward said base defining petals therebetween;

a disc shaped top wad in said tubular portion spaced from said open end over said plurality of projectiles; and a retaining means in said tubular portion of said cup spaced from said open end for retaining said top wad in said tubular portion when said cartridge is inserted into said bore of said muzzle loading firearm, said retaining means being selected from the group consisting essentially of 1) said tubular portion having a circumferential groove spaced from said open end engaging a peripheral portion of said wad and 2) said tubular portion having an inwardly projecting circumferential ridge engaging a complementary shaped groove in a peripheral rim portion of said wad.

2. The cartridge according to claim 1 wherein said retaining means is a circumferential groove in an internal surface of each of said petals spaced from said open end.

3. The cartridge according to claim 2 wherein said circumferential groove has a complementary shape to a circumferential rim portion of said top wad.

4. The cartridge according to claim 1 wherein said retaining means is an inwardly projecting circumferential spaced from said open end on each of said petals engagable with a circumferential groove in a peripheral rim portion of said top wad.

5. The cartridge according to claim 1 further comprising a bottom wad fastened to said base portion.

6. The cartridge according to claim 1 further comprising a tubular storage sleeve over at least said tubular portion of said cup, said sleeve being sized to prevent said retaining means from disengaging said top wad while said cup containing said projectiles and retaining said top wad is being handled prior to insertion of said projectile containing cup into said bore of said muzzle loading firearm.

7. The cartridge according to claim 6 wherein said storage sleeve is open ended and has an outer diameter greater than the bore of said muzzle loading firearm so that said sleeve is retained at the muzzle of said firearm as said cup containing said projectiles and said top wad is pushed into the bore of said firearm.

8. The cartridge according to claim 7 further comprising a pair of removable end caps on said open ends of said sleeve to retain said cup within said sleeve.

9. The cartridge according to claim 1 wherein said base portion of said cup has a concave outer end surface for abutting against a propellant charge in said firearm, said end surface providing a gas seal during ignition of said propellant charge.

10. A plastic shot cup assembly for use in a muzzle loading firearm to contain shot, said shot cup assembly comprising:

a cup having a base portion and a cylindrical tubular portion having an open end, said tubular portion having a plurality of longitudinal slots therein extending from said open end toward said base portion defining petals therebetween, a plurality of said petals of said tubular portion having a retaining means spaced from said open end; and a disc shaped top wad for insertion in said tubular portion over said shot, said top wad being sized to engage said retaining means of said petals and spaced from said open end to retain said shot in said tubular portion said retaining means being selected from the group consisting essentially of 1) a plurality of said petals each having a circumferential groove spaced from said open end engaging a peripheral portion of said wad and 2) a plurality of said petals each having an inwardly projecting circumferential ridge engaging a complementary shaped groove in a peripheral rim portion of said wad.

11. The cup assembly according to claim 10 wherein said retaining means is a circumferential groove in an inwardly facing surface of each of said petals spaced from said open end adapted to receive a rim portion of said top wad.

12. The cup assembly according to claim 11 wherein said circumferential groove has a complementary shape to said peripheral rim portion of said top wad.

13. The cup assembly according to claim 10 wherein said retaining means is an inwardly projecting circumferential ridge spaced from said open end on each of said petals.

14. The cup assembly according to claim 10 further comprising a bottom wad fastened to said base portion.

15. The cup assembly according to claim 10 further comprising a tubular storage sleeve sized to fit over at least said tubular portion of said cup, said sleeve being sized to prevent said retaining means from disengaging said top wad while said cup containing said shot and retaining said top wad is being handled prior to insertion of said shot containing cup into said muzzle of said muzzle loading firearm.

16. The cup assembly according to claim 15 wherein said storage sleeve is open ended and has an outer diameter greater than the bore of said muzzle loading firearm so that said sleeve is retained at the muzzle of said firearm as said cup containing said shot and said top wad is pushed into the bore of said firearm.

17. The cup assembly according to claim 10 wherein said base portion of said cup has a concave outer end surface for abutting against a propellant charge in said firearm, said end surface providing a gas seal during ignition of said propellant charge.

18. The cup assembly according to claim 15 wherein said sleeve has an inwardly projecting rib sized to engage said tubular portion of said cup to retain said sleeve in place during handling and transport of said cup assembly.

19. A process for loading a muzzle loading firearm having a bore comprising the steps of:

a) providing a shot cartridge including a plastic shot cup having a base portion and a cylindrical tubular portion, a load of shot contained in said tubular portion, said tubular portion having an open end and a plurality of longitudinal slots extending toward said base portion from said open end defining petals therebetween, a disc shaped top wad in said tubular portion and spaced from said open end over said shot, and a circumferential retaining means in said tubular portion of said cup spaced from said open end for retaining said top wad in said open end when said cartridge is inserted into the bore of said muzzle loading firearm, said retaining means being selected from the group consisting essentially of 1) said tubular portion having a circumferential groove spaced from said open end engaging a peripheral portion of said wad and 2) said tubular portion having an inwardly projecting circumferential ridge engaging a complementary shaped groove in a peripheral rim portion of said wad;

b) loading a powder charge into the bore of a muzzle loading firearm;

c) positioning said base portion of said cartridge against said muzzle and in alignment with said bore; and d) pushing against the top wad of the shot cartridge with a ramrod to push said shot cartridge down the bore of said firearm until said cartridge seats against said powder charge.

20. The method according to claim 19 wherein said step of providing a shot cartridge further comprises placing said cartridge in a sleeve having an internal diameter about equal to the diameter of said bore and an outer diameter greater than said bore of said muzzle loading firearm.

21. The method according to claim 20 further comprising the steps of:

i) positioning the sleeve against the muzzle of the firearm with the base portion of the shot cartridge in alignment with the bore;

ii) holding the sleeve against the muzzle; and iii) pushing the cartridge through the sleeve and into the bore of the firearm until the cartridge is seated against the powder charge.

* * * * *